US006306341B1

(12) United States Patent
Yokota et al.

(10) Patent No.: US 6,306,341 B1
(45) Date of Patent: Oct. 23, 2001

(54) STAINLESS STEEL PRODUCT HAVING EXCELLENT ANTIMICROBIAL ACTIVITY AND METHOD FOR PRODUCTION THEREOF

(75) Inventors: Takeshi Yokota; Misako Tochihara; Susumu Satoh, all of Chiba; Sadao Hasuno, Tokyo, all of (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/463,830

(22) PCT Filed: Jun. 3, 1999

(86) PCT No.: PCT/JP99/02972

§ 371 Date: Jan. 28, 2000

§ 102(e) Date: Jan. 28, 2000

(87) PCT Pub. No.: WO99/64640

PCT Pub. Date: Dec. 16, 1999

(30) Foreign Application Priority Data

Jun. 5, 1998 (JP) ..... 10-158091

(51) Int. Cl.[7] ..... C22C 38/18; C22C 38/24

(52) U.S. Cl. ..... 420/35; 420/70; 420/71; 148/325; 148/542

(58) Field of Search ..... 420/34, 35, 43, 420/69, 70, 71; 148/320, 327, 542, 546

(56) References Cited

FOREIGN PATENT DOCUMENTS 9-249948-A * 9/1997 (JP) .
10-259456-A * 9/1998 (JP) .
J1-12692-A * 1/1999 (JP) .
11-29879-A * 2/1999 (JP) .

* cited by examiner

*Primary Examiner*—Deborah Yee
(74) *Attorney, Agent, or Firm*—Schnader Harrison Segal & Lewis LLP

(57) ABSTRACT

The present invention provides a stainless steel having superior corrosion resistance, antibacterial properties, and durability, the antibacterial properties being maintained after surface treatments commonly performed including, for example, polishing. In particular, the stainless steel contains not less than 10 percent by weight of chromium, 0.001 to 0.30 percent by weight of silver, or further contains 0.001 to 1.0 percent by weight of vanadium. In addition, not less than 0.0005 weight percent of a silver oxide, the amount thereof being not more than 1.1 times that of the silver, is dispersed in the stainless steel. In order to homogeneously disperse the silver oxide in the stainless steel, when continuous casting of molten steel is performed, the casting rate for the continuous casting is preferably 0.8 to 1.6 m/min. A method for manufacturing the stainless steel is also disclosed.

10 Claims, 1 Drawing Sheet

STAINLESS STEEL PRODUCT HAVING EXCELLENT ANTIMICROBIAL ACTIVITY AND METHOD FOR PRODUCTION THEREOF

TECHNICAL FIELD

The present invention relates to stainless steel. More particularly, the present invention relates to stainless steel having antibacterial properties which is suitably used for apparatuses such as kitchen fixtures, medical apparatuses, electrical appliances, chemical apparatuses, and building materials, and also relates to a manufacturing method therefor. The steel according to the present invention are in forms including sheets, strips, pipes, and wires.

BACKGROUND ART

It is well known that silver and copper have inhibitory effects on pathogenic bacteria growth, typically represented by *Escherichia coli* and *salmonella,* and acts for preventing food poisoning caused by pathogenic bacteria.

Recently, materials provided with inhibitory effects on bacterial growth (hereinafter referred to as antibacterial characteristics) by using these metals have been proposed. In Japanese Unexamined Patent Application Publication No. 8-49085, for example, a stainless steel sheet having superior antibacterial properties is disclosed; on the surfaces of the stainless steel sheet, metal layers or alloy layers of chromium, titanium, nickel, iron and the like containing silver and/or copper are formed by magnetic sputtering. In this steel sheet, metal layers or alloy layers formed containing 19 to 60 percent by weight of silver is preferable.

In Japanese Unexamined Patent Application Publication No. 8-156175, a steel sheet coated by pigments containing silver, which can suppress bacterial growth, is proposed.

However, in the methods described above for forming the metal layers or the alloy layers on the steel sheet surfaces including metals having the antibacterial properties, and in the methods for coating the pigments including the metals having the antibacterial properties, the layers including the metals having the antibacterial properties are stripped or removed by drawing and surface polishing, and the problems are that the effects cannot thereby be anticipated. In applications, such as steel sheets used for the interiors of washing machines, which are continually abraded, and steel sheets used for kitchens which are frequently scrubbed for cleaning, the problem is that the antibacterial properties do not last over long periods of time. In the methods described above, additional steps for manufacturing the steel sheets are required to form coating layers, metal layers, and alloy layers. In addition, when steel sheets are made thinner, since the amounts of coating, metal layers, and alloy layers per weight increase concomitant with an increase of surface area per weight, there is a disadvantage in terms of cost.

In order to solve the problems described above, there have been proposed austenitic stainless steel enhancing antibacterial properties by adding 1.1 to 3.5 percent by weight of copper as disclosed in Japanese Unexamined Patent Application Publication No. 8-104953; martensitic stainless steel enhancing antibacterial properties by adding 0.3 to 5 percent by weight of copper as disclosed in Japanese Unexamined Patent Application Publication No. 8-104952; and ferritic stainless steel enhancing antibacterial properties by adding 0.4 to 3.0 percent by weight of copper as disclosed in Japanese Unexamined Patent Application Publication No. 9-170053.

However, in the technologies disclosed in Japanese Unexamined Patent Application Publications Nos. 8-104953, 8-104952, and 9-170053, copper ions must leach from the surfaces of the steel sheets to produce the antibacterial properties. The leaching of copper in ionic form is due to breakage of passivation layers at the leaching points, and corrosion resistance is therefore seriously degraded, even though antibacterial properties are improved. Accordingly, it is difficult for stainless steel having copper therein to have antibacterial properties and corrosion resistance at the same time.

Objects of the present invention are to provide stainless steel and a manufacturing method therefor by solving the problems in the conventional technologies. The stainless steel of the present invention has superior antibacterial properties and corrosion resistance, and continues to have superior antibacterial properties even after surface processing is performed, such as polishing.

DISCLOSURE OF INVENTION

In order to develop stainless steel sheets having superior antibacterial properties and corrosion resistance, intensive research of the relationship between chemical compositions of stainless steel sheet surfaces and antibacterial properties were made by the inventors of the present invention by fully utilizing analytical instruments, such as a field emission Auger electron spectroscope and an electron beam microanalyser. Consequently, by adding an optimum amount of silver to stainless steel and by dispersing optimum amounts of silver on the surface and the inside of the stainless steel, the inventors found that stainless steel having superior antibacterial properties and also superior corrosion resistance could be obtained. In addition, the inventors of the present invention found that a continuous casting rate and an addition of vanadium had a substantial effect on the homogeneous dispersion of the silver. Furthermore, the inventors of the present invention found that the steel provided with the optimum amount of silver homogeneously dispersed therein had stable antibacterial properties for applications in which the steel was subject to mold pressing and polishing, and in which the surfaces of the steel were scrubbed or abraded during use.

The present invention was accomplished based on the above knowledge in conjunction with further research therefor.

Accordingly, a first aspect of the invention is that a stainless steel, having antibacterial properties, comprises not less than 10 percent by weight of chromium, 0.001 to 0.30 percent by weight of silver, and not less than 0.0005 percent by weight of a silver oxide, the amount of the silver oxide being not more than 1.1 times that of the silver.

A second aspect of the invention is that the stainless steel, having the antibacterial properties according to the first aspect of the invention, further comprises 0.001 to 1.0 percent by weight of vanadium.

A third aspect of the invention is that the stainless steel, having the antibacterial properties according to the first aspect and the second aspect of the invention, further comprises not more than 0.015 percent by weight of sulfur.

A fourth aspect of the invention is the stainless steel, having the antibacterial properties according to the first aspect to the third aspect of the invention, wherein the silver content is not less than 0.001 and is less than 0.05 percent by weight of the stainless steel.

A fifth aspect of the invention is the stainless steel, having the antibacterial properties according to the second aspect of the invention, wherein the vanadium content is 0.001 to 0.30 percent by weight of the stainless steel.

A sixth aspect of the invention is the stainless steel having the antibacterial properties according to the first aspect to the fifth aspect of the invention, wherein the stainless steel is in the form of any one of a sheet, a strip, a pipe, and a wire.

A seventh aspect of the invention is a method for manufacturing a stainless steel raw material, comprising the steps of controlling amounts of not less than 10 percent by weight of chromium, 0.001 to 0.30 percent by weight of silver, and not more than 0.015 percent by weight of sulfur in molten stainless steel, and performing continuous casting of the molten stainless steel at a casting rate of 0.8 to 1.6 m/min.

A eighth aspect of the invention is the method for manufacturing the stainless steel according to the seventh aspect of the invention, in which the molten stainless steel further comprises 0.001 to 1.0 percent by weight of vanadium.

A ninth aspect of the invention is that the method for manufacturing the stainless steel, having antibacterial properties according to the seventh aspect and the eighth aspect of the invention, further comprises the steps of hot rolling and cold rolling.

The reasons for specifying the chemical composition of the steel according to the present invention will be described hereunder.

The composition of the stainless steel of the present invention is suitable for the austenitic stainless steel, the ferritic stainless steel, the martensitic stainless steel, and other various stainless steel.

The chemical composition of the austenitic stainless steel is preferably as follows; 0.001 to 0.1 percent by weight of carbon, not more than 2.0 percent by weight of silicon, not more than 2.0 percent by weight of manganese, not more than 0.1 percent by weight of phosphorus, 10 to 35 percent by weight of chromium, 6 to 15 percent by weight of nickel, 0.001 to 0.1 percent by weight of nitrogen, and the balance being iron and incidental impurities. In addition, one or more elements selected from the group of molybdenum, not more than 3.0 percent by weight; copper, not more than 1.0 percent by weight; tungsten, not more than 0.30 percent by weight; aluminum, not more than 0.3 percent by weight; titanium, not more than 1.0 percent by weight; niobium, not more than 1.0 percent by weight; zirconium, not more than 1.0 percent by weight; cobalt, 0.001 to 0.5 percent by weight; and boron, not more than 0.01 percent by weight, may be included in the austenitic stainless steel.

The chemical composition of the ferritic stainless steel is preferably as follows; 0.0001 to 0.1 percent by weight of carbon, not more than 1.0 percent by weight of silicon, not more than 2.0 percent by weight of manganese, not more than 0.1 percent by weight of phosphorus, 10 to 50 percent by weight of chromium, not more than 0.10 percent by weight of nitrogen, and the balance being iron and incidental impurities. In addition, one or more elements selected from the group of aluminum, not more than 0.3 percent by weight; nickel, not more than 1.0 percent by weight; molybdenum, not more than 3.0 percent by weight; titanium, not more than 1.0 percent by weight; niobium, not more than 1.0 percent by weight; zirconium, not more than 1.0 percent by weight; copper, not more than 1.0 percent by weight; tungsten, not more than 0.30 percent by weight; cobalt, 0.001 to 0.5 percent by weight; and boron, not more than 0.01 percent by weight, may be included in the ferritic stainless steel.

The chemical composition of the martensitic stainless steel is preferably as follows; 0.001 to 1.0 percent by weight of carbon, not more than 1.0 percent by weight of silicon, not more than 2.0 percent by weight of manganese, not more than 0.1 percent by weight of phosphorus, 10 to 19 percent by weight of chromium, 0.001 to 0.1 percent by weight of nitrogen, and the balance being iron and incidental impurities. In addition, one or more elements selected from the group of aluminum, not more than 1.5 percent by weight; titanium, not more than 1.0 percent by weight; niobium, not more than 1.0 percent by weight; tungsten, not more than 0.3 percent by weight; zirconium, not more than 1.0 percent by weight; nickel, not more than 3.0 percent by weight; molybdenum, not more than 3.0 percent by weight; copper, not more than 1.0 percent by weight; cobalt, 0.001 to 0.5 percent by weight; and boron, not more than 0.01 percent by weight may be included in the martensitic stainless steel.

According to the present invention, the stainless steel containing not less than 10 percent by weight of chromium, and preferably, the stainless steel having the composition described above, includes 0.001 to 0.30 percent by weight of silver, or further includes 0.001 to 1.0 percent by weight of vanadium. In addition, the stainless steel includes not less than 0.0005 percent by weight of a silver oxide, the amount of the silver oxide being not more than 1.1 times that of the silver (percent by weight) in the stainless steel. According to the composition described above, stable and extremely superior antibacterial properties can be obtained without degradation of corrosion resistance.

Chromium: Not Less Than 10 Percent by Weight

The reason the chromium content is determined to be not less than 10 percent by weight is that corrosion resistance is poor when the chromium content is less than 10 percent by weight. The upper limit of the chromium content is not specifically set; however, not more than 50 percent by weight of chromium is preferable in view of workability and productivity.

Silver: 0.001 to 0.30 Percent by Weight

Silver is a most important element of the present invention, having an inhibitory effect on bacterial growth and enhancing antibacterial properties. These effects of the silver are observed at amounts of not less than 0.001 percent by weight; however, when the silver content exceeds 0.30 percent by weight, corrosion resistance is degraded and surface defects increase during hot rolling. In addition, there is a disadvantage in terms of cost due to addition of a large amount of expensive silver. Hence, the silver content is specified to be in the range of 0.001 to 0.30 percent by weight. More preferably, the silver content is less than 0.05 percent by weight.

Silver contained in the stainless steel is present in the form of silver (Ag) particles, a silver oxide, and a silver sulfide. According to the understanding of the inventors of the present invention, the antibacterial properties are superior in the order of a silver oxide>silver particles>a silver sulfide, and therefore, most of the silver in the present invention is to be present in the form of a silver oxide in order to markedly enhance antibacterial properties.

The particular reasons the antibacterial properties are superior in the order a silver oxide, silver particles, and a silver sulfide are not clearly understood at present; however, since a silver oxide has the highest rate of leaching of silver ions which have antibacterial properties, it is supposed that a silver oxide exhibits high antibacterial properties because of this high rate of leaching.

Hence, the stainless steel according to the present invention contains not less than 0.0005 percent by weight of a silver oxide, the amount of the silver oxide being not more than 1.1 times that of the silver (percent by weight) in the stainless steel. When the amounts of the silver oxide described above are homogeneously dispersed and present in the stainless steel, the silver oxide is always present on the surfaces of the steel, that is, not only on the surfaces of the steel at the time of shipment, but also on the surfaces thereof after polishing, machining, and grinding, and on the surfaces thereof which are newly exposed by abrasion during use. Accordingly, the growth of bacteria is inhibited and antibacterial properties are enhanced. The silver oxide is, for example, AgO or $Ag_2O$.

When a silver oxide having superior antibacterial properties is contained in steel sheets at not less than 0.0005 percent by weight, good antibacterial properties can be obtained. When the content of the silver oxide is less than 0.005 percent by weight, sufficient inhibitory on bacterial growth may not be expected; the lower limit of the content of the silver oxide is therefore determined to be 0.0005 percent by weight. In contrast, when the content of the silver oxide exceeds 1.1 times the amount of the silver in the stainless steel, the silver oxide readily gathers at grain boundaries and the like, and tends to form large coarse oxide, and as a result, corrosion resistance is degraded. In order to fully utilize the antibacterial properties of the silver oxide, the upper limit of the content of the silver oxide is determined to be not more than 1.1 times the amount of the silver (percent by weight) in the stainless steel. Specific forms of the silver oxide in the stainless steel of the present invention are not required; however, since the silver oxide particles exceeding 500 $\mu$m may cause degradation of corrosion resistance and workability, a size which is not greater than 500 $\mu$m is preferable.

The amount of the silver oxide generated in the stainless steel according to the present invention is measured by an inclusion analysis using an electroextraction method, or is measured on a random sectional surface of a test piece sampled from the steel by a field emission Auger electron spectroscope or an electron beam microanalyser.

In the present invention, in addition to the silver in the range described above, 0.001 to 1.0 percent by weight of vanadium is preferably contained. Measured results of the antibacterial properties at the surface and at the center of a 1.0 mm-thickness BA (Bright Annealing) product of the stainless steel influenced by addition of vanadium is shown in FIG. 1. The BA product was obtained from a slab of 16.2%-Cr stainless steel containing 0.042 percent by weight of silver through the steps of hot rolling, annealing for a hot-rolled plate (850° C.×60 seconds), cold-rolling, and bright annealing (850° C.×60 seconds). Stable antibacterial properties were obtained at the center of the steel product regardless of the addition of the vanadium; however, in contrast, at the surface, the antibacterial properties were degraded when the added amount of vanadium was less than 0.001 percent by weight. The reason for this is believed to be that vanadium acts as a so-called "dispersing agent" which remarkably suppress the tendency of silver particles, a silver oxide, and a silver sulfide to be locally concentrated at the central interior of the plate. When the vanadium is contained at not less than 0.001 percent by weight, consistent antibacterial effects at the surfaces of the steel can be obtained. In contrast, when the vanadium content is more than 0.30 percent by weight, the effect described above is saturated, and when the vanadium content is more than 1.0 percent by weight, workability and corrosion resistance tend to be degraded. Therefore, the vanadium in the range of 0.001 to 1.0 percent by weight is preferable. More preferably, the range is 0.001 to 0.30 percent by weight, and further preferably the range is 0.01 to 0.25 percent by weight.

The stainless steel according to the present invention is composed of the chemical compositions in the ranges described above, and iron and incidental impurities as the balance.

Since the steel according to the present invention can be manufactured by any one of known steel making techniques, manufacturing methods are not required to be specified. A preferably manufacturing method is, for example, a secondary refining by SS-VOD (Strongly Stirred Vacuum Oxygen Decarbonization) following the step of the steel making technique by using a steel converter, an electric furnace, and the like.

According to the present invention, a molten stainless steel is manufactured by a known steel making technique, in which the molten stainless steel having a stainless steel composition, provided with not less than 10 percent by weight of chromium, further contains 0.001 to 0.30 percent by weight of silver, or still further contains 0.001 to 1.0 percent by weight of vanadium. The molten steel thus manufactured can be made in steel raw material by using known casting methods; however, in view of productivity and quality, continuous casting is preferably employed.

In the continuous casting, in order to finely and homogeneously disperse not less than 0.0005 percent by weight of silver oxide in the steel, the casting rate is determined to be in the range of 0.8 to 1.6 m/min. Concomitant with determining the casting rate, the sulfur content in molten stainless steel is determined to be not more than 0.015 percent by weight, and more preferably, not more than 0.010 percent by weight.

When the casting rate is less than 0.8 m/min, the silver oxide particles become coarse and large, corrosion resistance is degraded, and stable antibacterial properties are thereby difficult to obtain. In contrast, when the casting rate exceeds 1.6 m/min, stable casting is difficult to perform and not less than 0.0005 percent by weight of the silver oxide is not homogeneously dispersed in the steel. Hence, the silver oxide dispersed heterogeneously at the surface of the steel, and stable antibacterial properties during use cannot be obtained. Accordingly, the casting rate in the continuous casting is preferably in the range of 0.8 to 1.6 m/min.

In order that the silver oxide is in the predetermined range of not less than 0.0005 percent by weight and not more than 1.1 times the amount of the silver (percent by weight) in the stainless steel, the sulfur content in the molten stainless steel is not more than 0.015 percent by weight, more preferably not more than 0.010 percent by weight, concomitant with the casting rate being 0.8 to 1.6 m/min. An adjustment of the sulfur content in the molten stainless steel may be performed by known refining methods and is not particularly specified; however, a desulfurization method by adding a ferrosilicon and calcium compounds in steel converters and/or VOD furnaces is preferable.

When the sulfur content in the molten stainless steel is more than 0.015 percent by weight, silver sulfides generated by reactions with the silver increase, and antibacterial properties are degraded because the amount of the silver oxide generated, having superior antibacterial properties, is decreased. Accordingly, in order to obtain superior antibacterial properties, the sulfur content in the molten steel is preferably not more than 0.015 percent by weight.

According to the present invention, steel raw materials are manufactured from the molten stainless steel having the above-described compositions by continuous casting, preferably under the conditions described above, and if necessary, are subjected to heat treatment at a predetermined temperature followed by hot-rolling, hot-rolled sheets of a given thickness thereby being obtained. The hot-rolled sheets are, if necessary, annealed at 700 to 1,200° C. and are applied to desired applications as hot-rolled sheets or cold-rolled sheets having desired thickness processed by the following cold rolling. The cold-rolled sheets are manufactured preferably through annealing at 700 to 1,200° C. and, if necessary, through pickling.

BEST MODE FOR CARRYING OUT THE INVENTION

EXAMPLE

Figure 1:
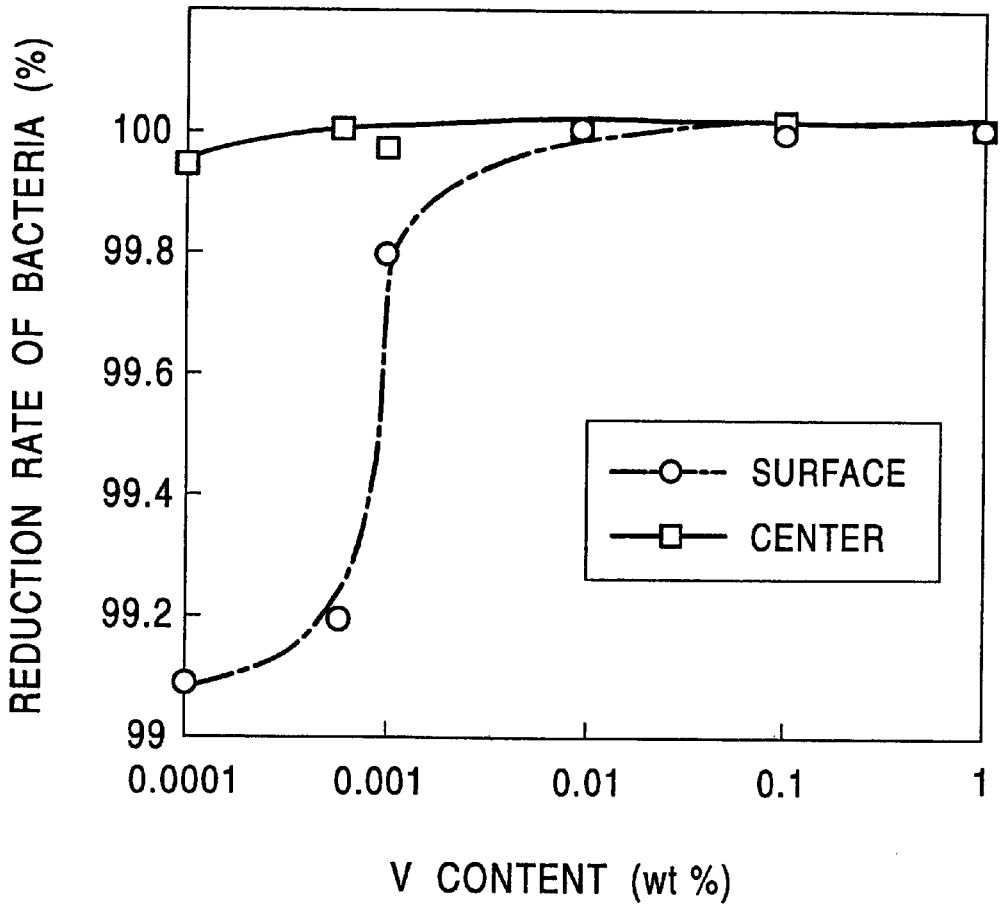
FIG. 1 is a graph showing the relationship between the reduction rate of number of bacteria and the vanadium content at a surface and a center of a steel sheet.

Slabs (steel raw material) 200 mm thickness were prepared by a continuous casting method at various casting speeds from stainless steel having chemical compositions shown in Tables 1 and 2 made by a steel making technique, and the slabs were heated and hot-rolled, so that hot-rolled steel sheets 4 mm thickness were obtained. Next, the hot-rolled steel sheets were annealed at 700 to 1,200° C. and were treated by pickling followed by cold rolling, and cold-rolled steel sheets 0.8 mm thickness were thereby obtained. By annealing the cold-rolled steel sheets, and when required, by pickling the sheets, cold-rolled sheets having various surface finishes were prepared. The annealing temperatures employed for the cold-rolled steel sheets were 1,000 to 1,200° C. for austenitic stainless steel, 800 to 1,100° C. for ferritic stainless steel, 750 to 1,000° C. for martensitic stainless steel. Some of the stainless steel sheets were treated by polishing based on the Japanese Industrial Standard (hereinafter referred to as JIS) R6001, and #320 and #400 surface finished stainless sheets were prepared.

Evaluations of corrosion resistance and antibacterial properties of the annealed cold-rolled steel sheets were performed. In order to confirm persistency and durability of the antibacterial properties, an evaluation of the antibacterial properties was performed again after the evaluation of corrosion resistance.

A method for performing each evaluation will be described below.

(1) Evaluation of Antibacterial Properties

Antibacterial properties were evaluated in accordance with the film adhesion method defined by the Study Group on Silver and Other Inorganic Antibacterial Agents. The procedure of the film adhesion method by the Study Group on Silver and Other Inorganic Antibacterial Agents are as follows.

1. A test piece having an area of 25 $cm^2$ is washed and degreased by using an absorbent cotton containing 99.5% ethanol.
2. *Escherichia coli* are dispersed in a 1/500 NB solution. (The number of bacteria are adjusted to be $2.0\times10^5$ to $1.0\times10^6$ cfu (colony form unite)/ml. The 1/500 NB solution is generally a nutrient broth medium (NB) diluted 500 times by sterilized and purified water. The nutrient broth medium (NB) is, in general, a mixture of 5 g of a meat extract, 5.0 g of sodium chloride, 10.0 g of a peptone, and 1.000 ml of purified water; the pH thereof is 7.0±0.2.)
3. The solution containing bacteria is inoculated at a rate of 0.5 ml/25 $cm^2$ on the test piece (3 pieces each).
4. The surface of the test piece is covered by a film.
5. The test piece is cultivated for 24 hours at a temperature of 35±1.0° C. and a relative humidity (RH) not less than 90%.
6. The number of living bacteria are counted by an agar culture method (35±1.0° C., 40 to 48 hours).

Antibacterial properties were evaluated by a reduction rate of bacteria as defined by the following equation.

Reduction rate (%)=100×(Number of bacteria in the control−Number of bacteria after the evaluation)/(Number of bacteria in the control)

The number of bacteria in the control is the number of living bacteria after the evaluations of antibacterial properties using stainless steel sheets containing no silver. The stainless steel sheets containing no silver used for the evaluations were SUS 430 (Steel No. 40) of ferritic stainless steel, SUS 304 (Steel No. 13) of austenitic stainless steel, and SUS 410 (Steel No. 23) of martensitic stainless steel. The initial number of bacteria from each test piece was approximately $2.3\times10^5$ cfu/piece. The number of bacteria after the evaluation was the number of living bacteria counted.

Persistency of antibacterial properties was also evaluated using the same method described above by using the test pieces used for the evaluation of corrosion resistance.

(2) Evaluation of Corrosion Resistance

Corrosion resistance was evaluated by the salt-dry-wet complex cycle test.

One cycle of the test is composed of treatments 1 and 2 as described below.

1. The test piece is sprayed with a 5.0% NaCl aqueous solution (temperature: 35° C.) for 0.5 hour, and this is then stored for 1.0 hour at a temperature of 60° C. and a humidity not greater than 40%.
2. The test piece is stored for 1.0 hour under the moist conditions at a temperature of 40° C. and a humidity not lower than 95%.

After performing predetermined numbers of cycles for each steel type, ratios of rust areas on the surfaces of the test pieces were measured. The predetermined numbers of cycles were 10 cycles for ferritic stainless steel, 30 cycles for austenitic stainless steel, and 5 cycles for martensitic stainless steel.

The evaluation results are shown in Tables 3 and 4. In the surface finish level listed in the Tables, 2B and BA are surface finish levels in accordance with JIS G4305, and #320 and #400 are polishing finish levels in accordance with JIS R6001.

As can be seen from Tables 3 and 4, it was confirmed that steel sheets (Examples of the present invention) containing silver in the range according to the present invention, and a silver oxide in the range according to the present invention, were superior in workability and corrosion resistance. In addition, superior antibacterial properties were confirmed in the evaluation thereof so as to decrease *Escherichia coli* by not less than 99%, and persistency of antibacterial properties was also superior, decreasing *Escherichia coli* in a manner similar to the above on test pieces already used for the evaluation of corrosion resistance. The persistency of antibacterial properties was maintained regardless of the surface finish of the steel sheets and sufficient antibacterial properties after polishing could also be confirmed.

The results described above can be confirmed regardless of the type of the stainless steel, such as ferritic stainless steel, austenitic stainless steel, and martensitic stainless steel.

In contrast, in the comparative examples, which are outside of the ranges of the present invention, regardless of the type of the stainless steel, reductions in *Escherichia coli* were small and antibacterial properties were degraded, or the antibacterial properties after the evaluation of corrosion resistance were decreased and the persistency of the antibacterial properties was degraded.

Industrial Applicability

The present invention provides stainless steel having superior antibacterial properties without degrading corrosion resistance and maintaining the antibacterial properties even after surface finishing, such as polishing, is performed. Therefore, advantages in terms of industrial uses of the stainless steel can therefore be obtained. The stainless steel according to the present invention is suitably used for applications, after forming and polishing are performed, focusing on sanitary aspects in moist environments, such as application in kitchens and baths.

TABLE 1

| Steel No. | Type | Chemical composition (wt %) C | Si | Mn | P | S | Cr | N | Al | Mo | Cu | Remarks |
|---|---|---|---|---|---|---|---|---|---|---|---|---|
| 11 | Austenite | 0.05 | 0.31 | 1.05 | 0.03 | 0.006 | 18.2 | 0.04 | 0.002 | 0.04 | 0.30 | Example of the present invention |
| 12 | | 0.05 | 0.30 | 1.04 | 0.03 | 0.005 | 18.2 | 0.04 | 0.002 | 0.04 | 0.31 | Example of the present invention |
| 13 | | 0.05 | 0.29 | 1.05 | 0.03 | 0.006 | 18.5 | 0.04 | 0.001 | 0.04 | 0.30 | Comparative example |
| 14 | | 0.04 | 0.33 | 1.03 | 0.03 | 0.005 | 18.2 | 0.04 | 0.002 | 0.04 | 0.31 | Example of the present invention |
| 15 | | 0.05 | 0.32 | 1.04 | 0.03 | 0.006 | 18.2 | 0.04 | 0.002 | 0.04 | 0.31 | Example of the present invention |
| 16 | | 0.05 | 0.30 | 1.02 | 0.03 | 0.005 | 18.2 | 0.04 | 0.002 | 0.04 | 0.30 | Comparative example |
| 17 | | 0.05 | 0.30 | 1.02 | 0.03 | 0.005 | 18.2 | 0.04 | 0.002 | 0.04 | 0.30 | Example of the present invention |
| 18 | | 0.05 | 0.30 | 1.01 | 0.03 | 0.009 | 18.3 | 0.03 | 0.001 | 0.04 | 0.30 | Comparative example |
| 21 | Martensite | 0.04 | 0.30 | 0.29 | 0.02 | 0.006 | 13.0 | 0.009 | 0.010 | — | — | Example of the present invention |
| 22 | | 0.04 | 0.31 | 0.29 | 0.02 | 0.005 | 13.0 | 0.009 | 0.010 | — | — | Example of the present invention |
| 23 | | 0.04 | 0.31 | 0.32 | 0.02 | 0.005 | 13.1 | 0.010 | 0.010 | — | — | Comparative example |
| 24 | | 0.04 | 0.29 | 0.31 | 0.02 | 0.005 | 13.1 | 0.009 | 0.010 | — | — | Example of the present invention |
| 25 | Martensite | 0.04 | 0.30 | 0.30 | 0.02 | 0.006 | 13.2 | 0.009 | 0.010 | — | — | Example of the present invention |
| 26 | | 0.04 | 0.31 | 0.30 | 0.02 | 0.006 | 13.0 | 0.010 | 0.010 | — | — | Comparative example |
| 27 | | 0.31 | 0.45 | 0.35 | 0.03 | 0.005 | 13.1 | 0.025 | 0.002 | — | — | Example of the present invention |
| 28 | | 0.32 | 0.35 | 0.45 | 0.02 | 0.006 | 12.6 | 0.025 | 0.002 | — | — | Example of the present invention |
| 29 | | 0.33 | 0.34 | 0.44 | 0.02 | 0.006 | 12.6 | 0.025 | 0.002 | — | — | Example of the present invention |

| Steel No. | Type | Chemical composition (wt %) Ni | Ti | Nb | B | W | Co | Zr | Ag | V | Remarks |
|---|---|---|---|---|---|---|---|---|---|---|---|
| 11 | Austenite | 8.30 | — | — | — | — | — | — | 0.042 | — | Example of the present invention |
| 12 | | 8.20 | — | — | — | 0.01 | 0.12 | — | 0.035 | 0.04 | Example of the present invention |
| 13 | | 8.30 | — | — | — | — | — | — | — | — | Comparative example |
| 14 | | 8.30 | — | — | — | — | — | — | 0.009 | 0.01 | Example of the present invention |
| 15 | | 8.30 | — | — | — | — | — | — | 0.25 | 0.03 | Example of the present invention |
| 16 | | 8.30 | — | — | — | — | — | — | 1.03 | 0.02 | Comparative example |
| 17 | | 8.30 | — | — | — | — | — | — | 0.055 | 0.37 | Example of the present invention |
| 18 | | 8.15 | — | — | — | — | — | — | 0.40 | 0.03 | Comparative example |
| 21 | Martensite | 0.07 | — | — | — | — | — | — | 0.035 | — | Example of the present invention |
| 22 | | 0.07 | — | — | — | 0.01 | 0.10 | — | 0.038 | — | Example of the present invention |
| 23 | | 0.06 | — | — | — | — | — | — | — | — | Comparative example |
| 24 | | 0.07 | — | — | — | — | — | — | 0.013 | 0.01 | Example of the present invention |
| 25 | Martensite | 0.06 | — | — | — | — | — | — | 0.22 | 0.02 | Example of the present invention |
| 26 | | 0.07 | — | — | — | — | — | — | 1.10 | 0.01 | Comparative example |
| 27 | | 0.25 | — | — | — | — | — | — | 0.037 | 0.01 | Example of the present invention |
| 28 | | 0.07 | — | — | — | — | — | — | 0.031 | 0.02 | Example of the present invention |
| 29 | | 0.07 | — | — | — | — | — | — | 0.031 | 0.38 | Example of the present invention |

TABLE 2

| Steel No. | Type | Chemical composition (wt %) C | Si | Mn | P | S | Cr | N | Al | Mo | Cu | Remarks |
|---|---|---|---|---|---|---|---|---|---|---|---|---|
| 31 | Ferrite | 0.06 | 0.31 | 0.60 | 0.03 | 0.003 | 16.2 | 0.031 | 0.001 | — | — | PI: Example of the present invention |
| 32 | | 0.05 | 0.30 | 0.61 | 0.03 | 0.003 | 16.3 | 0.035 | 0.001 | — | — | PI |
| 33 | | 0.05 | 0.30 | 0.59 | 0.03 | 0.003 | 16.2 | 0.022 | 0.070 | — | — | PI |
| 34 | | 0.007 | 0.10 | 0.30 | 0.03 | 0.009 | 16.2 | 0.008 | 0.020 | — | — | PI |
| 35 | | 0.005 | 0.06 | 0.19 | 0.02 | 0.004 | 17.9 | 0.008 | 0.030 | 1.45 | — | PI |
| 36 | | 0.004 | 0.07 | 0.19 | 0.03 | 0.005 | 19.1 | 0.009 | 0.020 | 1.39 | — | PI |
| 37 | | 0.011 | 0.31 | 0.47 | 0.03 | 0.009 | 17.7 | 0.015 | 0.002 | — | — | PI |
| 38 | | 0.009 | 0.47 | 0.14 | 0.02 | 0.002 | 19.1 | 0.014 | 0.019 | — | 0.55 | PI |
| 39 | | 0.011 | 0.49 | 0.51 | 0.03 | 0.004 | 11.4 | 0.006 | 0.033 | — | — | PI |
| 40 | | 0.06 | 0.30 | 0.61 | 0.03 | 0.003 | 16.1 | 0.041 | 0.002 | — | — | CE: Comparative example |
| 41 | | 0.05 | 0.33 | 0.60 | 0.02 | 0.002 | 16.3 | 0.029 | 0.001 | — | — | CE |
| 42 | | 0.0004 | 0.001 | 0.001 | 0.001 | 0.0003 | 16.2 | 0.0008 | 0.0005 | — | — | PI |
| 43 | | 0.06 | 0.30 | 0.60 | 0.03 | 0.002 | 16.3 | 0.035 | 0.002 | — | — | PI |
| 44 | | 0.06 | 0.30 | 0.59 | 0.03 | 0.003 | 16.2 | 0.044 | 0.002 | — | — | PI |
| 45 | | 0.06 | 0.31 | 0.61 | 0.03 | 0.006 | 17.5 | 0.01 | 0.002 | — | — | CE |

| Steel No. | Type | Chemical composition (wt. %) Ni | Ti | Nb | B | W | Co | Zr | Ag | V | Remarks |
|---|---|---|---|---|---|---|---|---|---|---|---|
| 31 | Ferrite | 0.20 | — | — | — | — | — | — | 0.037 | — | PI: Example of the present invention |
| 32 | | 0.31 | — | — | — | 0.01 | 0.11 | — | 0.041 | 0.012 | |
| 33 | | 0.12 | — | — | — | 0.01 | 0.15 | — | 0.020 | 0.021 | PI |
| 34 | | 0.11 | 0.16 | — | — | 0.01 | 0.10 | — | 0.050 | 0.010 | PI |
| 35 | | 0.12 | 0.23 | — | — | — | — | — | 0.035 | 0.014 | PI |
| 36 | | 0.12 | 0.19 | 0.01 | 0.0011 | 0.01 | 0.11 | — | 0.028 | 0.013 | |

TABLE 2-continued

| | | | | | | | | | | |
|---|---|---|---|---|---|---|---|---|---|---|
| 37 | 0.13 | — | 0.44 | — | 0.01 | 0.10 | — | 0.046 | 0.010 | |
| 38 | 0.38 | — | — | — | — | — | — | 0.022 | 0.020 | |
| 39 | 0.11 | 0.16 | — | — | — | — | — | 0.030 | 0.011 | PI |
| 40 | 0.18 | — | — | — | — | — | — | — | — | CE: Comparative example |
| 41 | 0.21 | — | — | — | — | — | — | 1.12 | 0.011 | CE |
| 42 | — | — | — | — | — | — | — | 0.021 | — | PI |
| 43 | 0.10 | — | — | — | — | — | — | 0.005 | 0.009 | PI |
| 44 | 0.31 | — | — | — | — | — | — | 0.269 | 0.37 | PI |
| 45 | 0.10 | — | — | — | — | — | — | 0.35 | 0.02 | CE |

TABLE 3

| | | | | | | Antibacterial characteristics | | | | |
|---|---|---|---|---|---|---|---|---|---|---|
| | | | | | Corrosion | Before corrosion resistance evaluation | | After corrosion resistance evaluation | | |
| Steel No. | Type | Continuous casting rate m/min | Amount of silver oxide (wt %) | Surface finish level | resistance Ratio of rust area (%) | Number of living bacteria (cfu/piece) | Reduction rate of bacteria (%) | Number of living bacteria (cfu/piece) | Reduction rate of bacteria (%) | Remarks |
| 11 | Auste- | 1.0 | 0.020 | 2B | 3 | <10 | >99.9 | $1.4 \times 10^4$ | 99.5 | Example of the present |
| 12 | nite | 1.0 | 0.019 | BA | 0 | <10 | >99.9 | <10 | >99.9 | Example of the present |
| | | 1.0 | 0.019 | 25 | 2 | <10 | >99.9 | <10 | >99.9 | Example of the present |
| | | 1.0 | 0.019 | #320 | 9 | <10 | >99.9 | <10 | >99.9 | Example of the present |
| | | 0.7 | 0.0004 | 23 | 17 | $6.7 \times 10^4$ | 97.4 | $9.2 \times 10^4$ | 96.7 | Comparative example |
| | | 1.8 | 0.0002 | 25 | 19 | $2.1 \times 10^5$ | 87.5 | $2.3 \times 10^5$ | 87.6 | Comparative example |
| 13 | | 1.1 | — | 2B | 5 | $2.6 \times 10^6$ | 0 | $2.6 \times 10^6$ | 0 | Comparative example |
| 14 | | 1.2 | 0.007 | 2B | 2 | $1.1 \times 10^3$ | >99.9 | $1.3 \times 10^3$ | >99.9 | Example of the present |
| 15 | | 1.5 | 0.024 | 2B | 3 | <10 | >99.9 | <10 | >99.9 | Example of the present |
| 16 | | 1.2 | 0.040 | 2B | 25 | <10 | >99.9 | $3.0 \times 10^5$ | 89.3 | Comparative example |
| 17 | | 1.2 | 0.040 | 2B | 3 | <10 | >99.9 | $2.8 \times 10^4$ | 99.0 | Example of the present |
| 18 | | 1.2 | 0.040 | 2B | 18 | <10 | >99.9 | $3.0 \times 10^5$ | 89.3 | Comparative example |
| 21 | Marten- | 0.9 | 0.021 | #400 | 5 | <10 | >99.9 | $3.9 \times 10^4$ | 99.5 | Example of the present |
| 22 | site | 0.9 | 0.023 | #400 | 3 | <10 | >99.9 | $3.9 \times 10^4$ | 99.5 | Example of the present |
| | | 1.7 | 0.0001 | #400 | 9 | $7.0 \times 10^6$ | 90.3 | $7.0 \times 10^5$ | 91.4 | Comparative example |
| 23 | | 1.0 | — | #400 | 6 | $7.2 \times 10^6$ | 0 | $8.1 \times 10^6$ | 0 | Comparative example |
| 24 | | 1.0 | 0.008 | #400 | 4 | $2.3 \times 10^3$ | >99.9 | $1.3 \times 10^3$ | >99.9 | Example of the present |
| 25 | | 1.0 | 0.039 | #400 | 5 | <10 | >99.9 | <10 | >99.9 | Example of the present |
| 26 | | 1.0 | 0.041 | #400 | 89 | <10 | >99.9 | $8.3 \times 10^5$ | 89.8 | Comparative example |
| 27 | | 1.1 | 0.025 | #400 | 17 | <10 | >99.9 | <10 | >99.9 | Example of the present |
| 28 | | 1.0 | 0.019 | #400 | 18 | <10 | >99.9 | <10 | >99.9 | Example of the present |
| 29 | | 1.2 | 0.010 | #400 | 17 | $2.5 \times 10^4$ | 99.7 | $3.9 \times 10^4$ | 99.5 | Example of the present |

TABLE 4

| | | | | | | Antibacterial characteristics | | | | |
|---|---|---|---|---|---|---|---|---|---|---|
| | | | | | Corrosion | Before corrosion resistance evaluation | | After corrosion resistance evaluation | | |
| Steel No. | Type | Continuous casting rate m/min | Amount of silver oxide (wt %) | Surface finish level | resistance Ratio of rust area (%) | Number of living bacteria (cfu/piece) | Reduction rate of bacteria (%) | Number of living bacteria (cfu/piece) | Reduction rate of bacteria (%) | Remarks |
| 31 | Ferrite | 1.2 | 0.026 | 2B | 7 | <10 | >99.9 | $1.5 \times 10^4$ | 99.5 | Example of the present |
| 32 | | 1.1 | 0.031 | BA | 2 | <10 | >99.9 | <10 | >99.9 | Example of the present |
| | | 1.1 | 0.031 | 2B | 6 | <10 | >99.9 | <10 | >99.9 | Example of the present |
| | | 1.1 | 0.031 | #320 | 9 | <10 | >99.9 | <10 | >99.9 | Example of the present |
| | | 0.7 | 0.11 | 2B | 27 | $3.2 \times 10^4$ | 98.9 | $3.9 \times 10^6$ | 87.0 | Comparative example |
| | | 1.8 | 0.0002 | 2B | 21 | $3.5 \times 10^5$ | 87.5 | $3.7 \times 10^5$ | 87.6 | Comparative example |
| 33 | | 0.9 | 0.012 | 2B | 5 | $2.1 \times 10^2$ | >99.9 | $2.5 \times 10^2$ | >99.9 | Example of the present |
| 34 | | 1.3 | 0.038 | 2B | 4 | <10 | >99.9 | <10 | >99.9 | Example of the present |
| 35 | | 1.5 | 0.024 | 2B | 3 | <10 | >99.9 | <10 | >99.9 | Example of the present |
| 36 | | 1.5 | 0.018 | 2B | 3 | $5.2 \times 10^1$ | >99.9 | $8.3 \times 10^1$ | >99.9 | Example of the present |
| 37 | | 1.2 | 0.033 | BA | 0 | <10 | >99.9 | <10 | >99.9 | Example of the present |

TABLE 4-continued

| Steel No. | Type | Continuous casting rate m/min | Amount of silver oxide (wt %) | Surface finish level | Corrosion resistance Ratio of rust area (%) | Antibacterial characteristics: Before corrosion resistance evaluation: Number of living bacteria (cfu/piece) | Before corrosion resistance evaluation: Reduction rate of bacteria (%) | After corrosion resistance evaluation: Number of living bacteria (cfu/piece) | After corrosion resistance evaluation: Reduction rate of bacteria (%) | Remarks |
|---|---|---|---|---|---|---|---|---|---|---|
| 38 | | 1.0 | 0.013 | 2B | 0 | $2.2 \times 10^2$ | >99.9 | $2.9 \times 10^2$ | >99.9 | Example of the present |
| 39 | | 1.2 | 0.015 | 2B | 15 | <10 | >99.9 | <10 | >99.9 | Example of the present |
| 40 | | 1.1 | — | 2B | 6 | $2.6 \times 10^6$ | 0 | $3.0 \times 10^6$ | 0 | Comparative example |
| 41 | | 0.9 | 0.040 | 2B | 73 | >10 | >99.9 | $4.5 \times 10^5$ | 85.0 | Comparative example |
| 42 | | 1.0 | 0.022 | BA | 0 | >10 | >99.9 | $2.7 \times 10^2$ | >99.9 | Example of the present |
| 43 | | 1.1 | 0.006 | BA | 3 | $1.2 \times 10^3$ | >99.9 | $1.3 \times 10^3$ | >99.9 | Example of the present |
| 44 | | 1.3 | 0.031 | BA | 4 | $1.8 \times 10^2$ | >99.9 | $1.5 \times 10^4$ | 99.5 | Example of the present |
| 45 | | 1.5 | 0.034 | 2B | 56 | $1.4 \times 10^2$ | >99.9 | $2.0 \times 10^2$ | >99.9 | Comparative example |

What is claimed is:

1. A stainless steel having antibacterial properties, comprising:

10 to 50 percent by weight of chromium effective to provide corrosion resistance; 0.001 to 0.30 percent by weight of silver; and 0.0005 percent by weight or more of a silver oxide, the amount of said silver oxide being 1.1 times the amount of said silver or less.

2. A stainless steel having antibacterial properties according to claim 1, further comprising 0.001 to 1.0 percent by weight of vanadium.

3. A stainless steel having antibacterial properties according to one of claims 1 and 2, further comprising not more than 0.015 percent by weight of sulfur.

4. A stainless steel having antibacterial properties according to any one of claims 1 to 3, wherein the silver content is 0.001 percent by weight to less than 0.05 percent by weight.

5. A stainless steel having antibacterial properties according to claim 2, wherein the vanadium content is 0.001 to 0.30 percent by weight.

6. A stainless steel having antibacterial properties according to one of claims 1 to 5, wherein the stainless steel is in the form of any one of a sheet, a strip, a pipe, and a wire.

7. A method for manufacturing a stainless steel raw material having antibacterial properties, comprising the steps of:

controlling amounts of not less than 10 percent up to 50% by weight of chromium, 0.001 to 0.30 percent by weight of silver, and not more than 0.015 percent by weight of sulfur in a molten stainless steel; and performing continuous casting of the molten stainless steel at a casting rate of 0.8 to 1.6 m/min.

8. A method for manufacturing a stainless steel having antibacterial properties according to claim 7, wherein the molten stainless steel further comprising 0.001 to 1.0 percent by weight of vanadium.

9. A method for manufacturing a stainless steel having antibacterial properties according to one of claims 7 and 8, further comprising steps of hot rolling and cold rolling.

10. A stainless steel selected from the group consisting of austenitic, ferritic and martinsitic stainless steel, said stainless steel having antibacterial properties comprising:

10–35% by weight of Cr when said steel is austenitic, 10–50% by weight of Cr when said steel is ferritic and 10–19% by weight of Cr when said steel is martinsitic, 0.001–0.30% by weight of silver, and at least 0.0005% by weight of silver oxide, wherein the amount of silver oxide is not more than 1.1 times the amount of silver present in said stainless steel.

* * * * *

UNITED STATES PATENT AND TRADEMARK OFFICE

CERTIFICATE OF CORRECTION

PATENT NO. : 6,306,341 B1
DATED : October 23, 2001
INVENTOR(S) : Yokota et al.

It is certified that error appears in the above-identified patent and that said Letters Patent is hereby corrected as shown below:

Column 9,
Table 1, at No. 18, subheading "S", change to "0.009" to -- 0.008 --.
Table 2, at No. 33, subheading "Mn", change "0.59" to -- 0.58 -- ;
At No. 34 subheading "S", change "0.009" to -- 0.008 --;
At No. 35 at subheading "Mn", change "0.19" to -- 0.18 --;
At No. 35 at subheading "Cr", change "17.9" to -- 17.8 --;
At No. 36 at subheading "Cr", change "19.1" to -- 18.1 --;
At No. 36 at subheading "Mo", change "1.39" to -- 1.38 --;
At No. 38 at subheading "C", change "0.009" to -- 0.008 --;
At No. 39 at subheading "N", change "0.006" to -- 0.008 --;
At No. 41 at subheading "N", change "0.029" to -- 0.028 --;
At No. 42 at subheading "C", change "0.0004" to -- 0.004 --.

Column 11,
Table 2, at No. 44, at subheading "Ag", please change "0.269" to -- 0.280 --.
Table 3, at subheading "Surface finish level" at row 3, please change "25" to -- 23 --; At row 5, please change "23" to -- 2B -- and row 6, please change "25" to -- 2B --; at the subheading "Corrosion resistance…", at row 15, please change "9" to -- 8 --.
Table 4, at subheading "Amount of silver…", row 1, please change "0.026" to -- 0.028 --.

Column 13,
Table 4, at subheading "Corrosion resistance…", row 3 , please change "6" to -- 8 --.

Signed and Sealed this

Twenty-fifth Day of June, 2002

*Attest:*

*Attesting Officer*

JAMES E. ROGAN
*Director of the United States Patent and Trademark Office*